United States Patent [19]

Kuhn

[11] Patent Number: 4,893,762

[45] Date of Patent: Jan. 16, 1990

[54] WINDING MACHINE WITH A DEVICE TO SEVER THE WINDING ROLL FROM THE WEB

[75] Inventor: Friedrich Kuhn, Heidenheim, Fed. Rep. of Germany

[73] Assignee: J. M. Voith GmbH, Heidenheim, Fed. Rep. of Germany

[21] Appl. No.: 280,895

[22] Filed: Dec. 7, 1988

[30] Foreign Application Priority Data

May 5, 1988 [DE] Fed. Rep. of Germany ... 8805965[U]

[51] Int. Cl.[4] ..... B65H 19/26

[52] U.S. Cl. ..... 242/56 R; 242/58.6; 242/65

[58] Field of Search ..... 242/56 R, 58.6, 65, 242/66

[56] References Cited

U.S. PATENT DOCUMENTS 2,801,810 8/1957 Kusel .
3,841,578 10/1974 Dörfel ..... 242/56 R X
4,444,360 4/1984 Kaipf et al. .
4,456,190 6/1984 Karttunen et al. ..... 242/56 R
4,508,283 4/1985 Beisswanger .
4,552,316 11/1985 Dropczynski et al. ..... 242/56 R
4,618,105 10/1986 Kuhn ..... 242/56 R
4,635,867 1/1987 Kytonen .
4,749,140 6/1988 Ruff .

FOREIGN PATENT DOCUMENTS 3243994 6/1984 Fed. Rep. of Germany .

*Primary Examiner*—Stuart S. Levy
*Assistant Examiner*—Steven M. du Bois
*Attorney, Agent, or Firm*—Albert L. Jeffers; Anthony Niewyk

[57] ABSTRACT

The winding machine is provided with a drum, across which a web to be wound is guided, with a lowering table for taking up an ejection of a winding roll from the machine and with a device for severing the winding roll from the web. The severing device is embedded along the drum-near edge area of a plate of the lowering table supporting the winding roll. To move the severing device between a rest position and an operating position in which it moves out of the lowering table, an actuating device is provided.

6 Claims, 1 Drawing Sheet

WINDING MACHINE WITH A DEVICE TO SEVER THE WINDING ROLL FROM THE WEB

BACKGROUND OF THE INVENTION

The field of the invention is that of winding machines, more specifically winding machines capable of severing a roll from a web.

A winding machine is disclosed in West German Pat. No. 3,243,994 and U.S. Pat. No. 4,508,283. It is desired that the machine's severing device permits safe severing of the web at a defined point so that the thus created start of the web has a sufficient length to mount a new winding tube. Therefore, the severing device must be arranged at a point on the lowering table where it can act on the web running between the drum and the winding roll on the lowering table. The severing device must not obstruct the transfer of the winding roll from the drum to the lowering table. Also it must not cause any damage at the outer layers of the winding roll. Furthermore, the severing device must be easily accessible for maintenance purposes. Finally the severing device must, however, be protected in such a way that injuries to the operating personnel of the winding machine are safely avoided.

SUMMARY OF THE INVENTION

The solution to the aforementioned problems involves the severing device being embedded in the lowering table when the severing device is not in use (rest position). Therefore, it does not interfere with the transfer of the winding roll on the lowering table and cannot be easily accessed, so that accidents are safely avoided. Also the severing device can be brought into a position (operating position) in which the device is especially effective to safely sever the web.

The present invention comprises a winding machine which has a drum, across which a web to be wound is guided, adjacent to which is a lowering table for taking up and ejecting a winding roll from the machine. A severing device is embedded in a plate of the lowering table, located on an edge area of the lowering table near the drum. An actuating device is also located on the lowering table and is connected to the severing device. The actuating device moves the severing device out of the plate from a rest position to an operating position. When in an operating position, the severing device severs a web on the lowering table.

Having a strip in a recess of the plate provides stable support of the severing device or the lowering table; additionally, it achieves a protective arrangement of the strip with a severing element. By aligning the plate and the strip, obstruction-free transfer of the winding roll without damage to the web layers is achieved. With the severing element being a toothed blade, it can penetrate with its toothed tips the tensioned web without great resistance and it perforates the tensioned web so that the web is safely severed. By attaching the severing element with bolts, rapid replacement of a worn severing element is possible. This maintenance work is best performed in the operating position of the severing device, since the severing element is then easily accessible. A lever can fulfill, with little design expenditure, the purpose of moving the severing device into its two positions. Significant forces are not required so that a relatively small pneumatic unit is sufficient.

DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
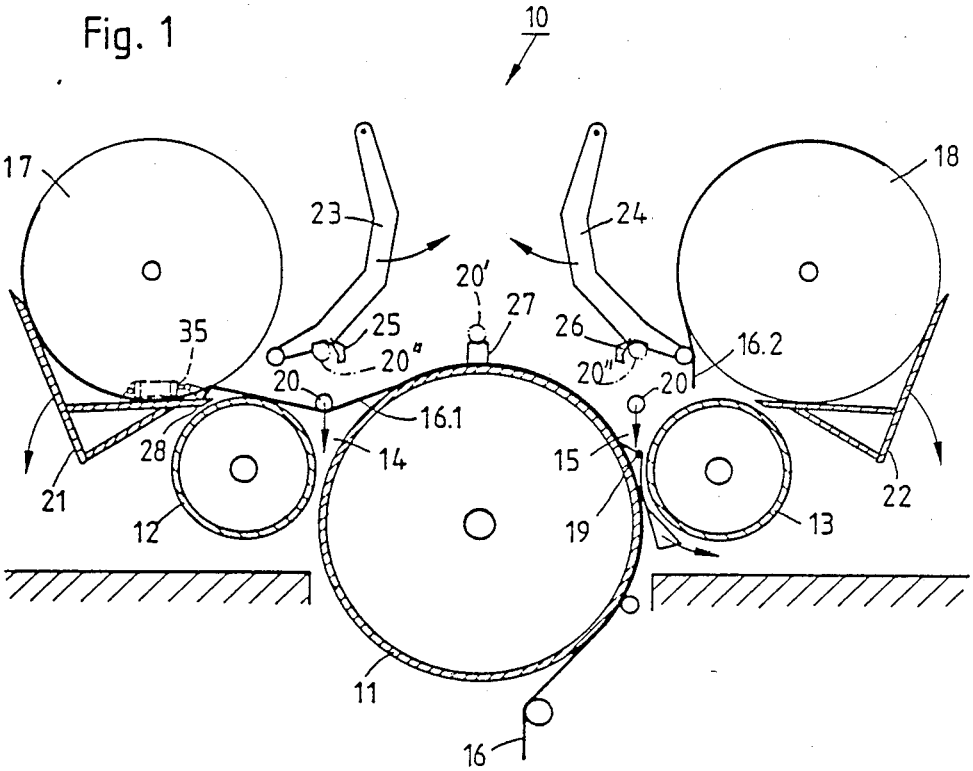
FIG. 1 shows a schematic side view of a winding machine (sectional view) with a severing device for the web arranged at the lowering table.

The winding machine 10 in FIG. 1 shows a central drum 11 with parallel supporting drums 12 and 13 on both sides of the central drum 11. In their upper gusset drums 11 and 12, as well as drums 11 and 13, form winding beds 14 and 15 respectively. A web 16 fed to the central drum 11 from below is slit into two web strips 16.1 and 16.2 by a lengthwise slitting device not (not shown). These strips 16.1 and 16.2 are wound to a roll 17 and 18 each in the appropriate winding bed 14 and 15 respectively. Web strip 16.1 runs into the winding bed 14 from above via central drum 11 to roll 17. In contrast, web strip 16.2 runs into the winding bed 15 from below roll 18.

A device which can be run in from below, around the supporting drum 13, is assigned to winding bed 15 to sever the strip 16.1 from the web 16. Such a severing device 19 is well known and is described in West German Pat. No. 3,109,587. To change finished rolls 17 and 18, new winding tubes 20 can be inserted into the appropriate winding bed, 14 and 15 respectively, in the manner described below.

On either side of each supporting drum 12 and 13, there is a lowering table, 21 and 22 respectively, for the finished rolls, 17 and 18 respectively, to lie during winding change. For the ejection of the finished winding rolls 17 and 18 from the winding beds, 14 and 15 respectively, ejection levers, 23 and 24 respectively, are arranged above the central drum 11. The winding rolls 17 and 18 are rolled off via the appropriate supporting drum 12 and 13 and rolled into lowering table 21 and 22, shown in their receiving positions. Lowering tables 21 and 22 can be moved in direction of the arrow, in order to eject winding rolls 17 and 18 from machine 10.

Levers 23 and 24 are provided with clamping pliers, 25 and 26 respectively, with which they can accept new winding tubes 20 (in position 20') having returned into the rest position in direction of the arrow. These new winding tubes 20 are kept ready on rail 27 running above central drum 11. During roll change the new winding tubes 20 (in position 20'') are engaged on either end by clamping heads (not shown) and lowered into winding beds 14 and 15 respectively. Such a machine equipment for tube insertion is known, and is described in West German Pat. No. 3,540,490, with the basic design of the winding machine described in West German Pat. No. 3,243,994.

Furthermore, the winding machine 10 is equipped with a device 28, along the edge area of lowering table 21 near the drum, to sever the winding rolls 17 from web strip 16.1, which runs in direction of winding bed 14. As can be easily seen from the enlarged presentation in FIG. 2, severing device 28 is embedded in a plate 29 of lowering table 21 supporting winding roll 17. Supporting plate 29 has in its edge area near the drum a machine-wide recess 30. Located within recess 30 and running parallel to drum 12, a strip 31 is supported pivotally by several cup-type hinges 32 distributed over its total length and by being bolted to supporting plate 29.

Along the drum-side, free edge zone of strip 31 is a severing element 33 for severing the web strip 16.1. Severing element 33 is mounted with bolts 34 between central drum 11 and winding roll 17 on lowering table 21. Severing element 33 comprises a toothed blade which is appropriately split into several individual elements over the machine width, typically several meters. However, a sawing wire, a heated wire or a knife blade can also be used as a severing element.

Severing device 28 is connected to an actuating device 35. Strip 31 of the severing device 28 is provided at least at one of its ends with a lever 36 on which acts a pneumatically operated piston-cylinder unit 37 supported at the lowering table 21 with its piston rod 38.

Figure 2:
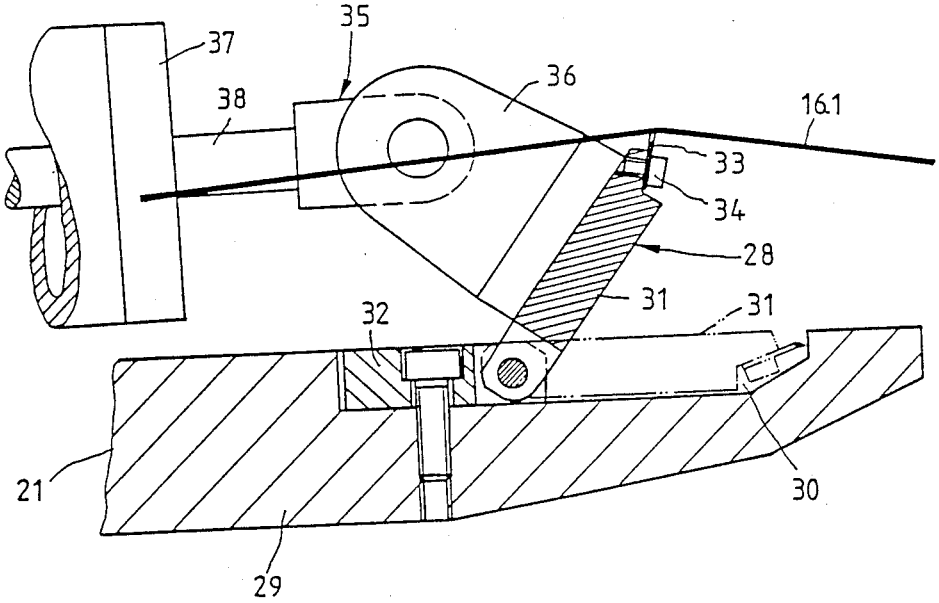
FIG. 2 shows the severing device on a larger scale.

During winding in machine 10, strip 31 is in its rest position shown with broken lines in FIG. 2. In this position, strip 31 is completely embedded by recess 30 together with severing element 33. The upper side of strip 31, across which winding roll 17 rolls off when ejected from machine 10, aligns with the appropriate side of supporting plate 29. By operation of actuating device 35, severing device 28 can be moved into its operating position as shown in FIG. 2. Strip 31, with its severing element 33, leaves recess 30 of lowering table 21 and forms an angle of approximately 60° to the upper side of supporting plate 29 when in its operating position.

During a roll change, the finished rolls 17 and 18 are rolled with the ejection levers 23 and 24 from the winding bed 14 and 15 across the supporting drums 12 and 13 to the lowering tables 21 and 22. Shortly before, the severing device 19 has been moved to its operating position, as shown in FIG. 1, in the winding bed 15. Winding roll 18 is therefore already severed from web strip 16.2. A vacuum, in the central drum 11, with a perforated shell keeps this web strip 16.2 at the drum so that the severing device 19 can be moved in direction of the arrow out of winding bed 15, in order to insert a new winding tube 20 and connect with web strip 16.2.

When winding roll 17 is moved from winding bed 14 to the lowering table 21, severing device 28 is, however, in rest position. As soon as winding roll 17 assumes its final position shown in FIG. 1 on the lowering table 21, severing device 28 is brought in its operating position by means of actuating device 35. Severing element 33 of the severing device 28 acts at web strip 16.1, extending from central drum 11 via winding bed 14, supporting drum 12 to the finished roll 18. Severing the web strip 16.1 can be done by lowering the new winding tube 20 engaged by clamping heads into winding bed 14. Winding tube 20 acts on web strip 16.1 and tensions the same so that severing element 33 penetrates and perforates the web strip. The further movement of the new winding tube 20 leads to severing web strip 16.1 along severing element 33.

The severing procedure can also be caused by swinging lower table 21 in direction of the arrow. In doing so, web strip 16.1 is also tensioned and severed at severing element 33 of severing device 28. In order to safely tension web strip 16.1, the central drum 11 is kept, in both variants of the severing procedure, in braking position and rail 27 is place on the roll, in order to keep the web strip in this position. Mounting the newly formed start of the web strip 16.1 at the new winding tube 20, can be done by gluing, pinning or a similar method. After ejection of winding rolls 17 and 18, winding machine 10 is again ready for winding.

The severing device 28 is not limited to winding machines with three drums. It can be used for machines with two rolls (so-called double winder drum winding machines) or also for machines with only one roll (so-called supporting drum winding machines). It is not necessary to split the web into strips in such machines. The described severing device can also be used for severing a web across the full width.

While the invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A winding machine comprising:

a drum, across which a web to be wound is guided;

a lowering table for taking up and ejecting a winding roll from said machine;

severing means for severing a winding roll from a tensioned web, said severing means being embedded in a plate of said lowering table and located along an edge area of said lowering table near said drum;

actuating means, connected to said severing means, for moving said severing means between a rest position and an operating position;

said severing means adapted to move out of said plate when said actuating means enables said severing means to assume an operating position.

2. A winding machine as described in claim 1 wherein said lowering table has a recess in said plate near said edge area, said severing means further comprising a base supported in a position parallel to said drum and located in said recess of said plate, said base having a strip in said recess of said plate near said drum, said strip being pivotally supported by said base in a position parallel to said drum, said strip further having at least one severing element embedded in said strip.

3. A winding machine as described in claim 2 wherein said strip is configured such that when in said rest position an upper surface of said plate aligns with said strip to provide a surface for a winding roll to roll upon during ejection from said machine.

4. A winding machine as described in claim 2 wherein said severing element comprises a toothed blade.

5. A winding machine as described in claim 2 wherein said severing element is bolted to said strip.

6. A winding machine as described in claim 2 further comprising at least one lever, each said lever coupled to an end of said strip, wherein said actuating means is a piston cylinder unit having a piston rod, said piston rod acting upon said lever to move said severing means between said operating and said rest positions.

* * * * *